United States Patent [19]

Elliott

[11] 4,237,080

[45] Dec. 2, 1980

[54] HUMIDIFIER ASSEMBLIES

[75] Inventor: Richard D. Elliott, Marietta, Ohio

[73] Assignee: Skuttle Mfg. Co., Marietta, Ohio

[21] Appl. No.: 2,794

[22] Filed: Jan. 11, 1979

[51] Int. Cl.[3] ..... B01F 3/04

[52] U.S. Cl. ..... 261/80; 126/113; 261/92; 261/DIG. 15

[58] Field of Search ..... 261/80, 92, DIG. 15, 261/103; 126/113; 137/315

[56] References Cited

U.S. PATENT DOCUMENTS

| | | | |
|---|---|---|---|
| 1,817,442 | 8/1931 | Martin, Jr. | 261/80 |
| 3,099,286 | 7/1963 | Powers | 137/315 |
| 3,193,259 | 7/1965 | Liebmann | 261/DIG. 15 |
| 3,203,676 | 8/1965 | Sprouse et al. | 261/80 X |
| 3,339,902 | 9/1967 | Martin | 261/80 X |
| 3,476,365 | 11/1969 | Agerley | 261/80 X |
| 3,615,075 | 10/1971 | Heiman et al. | 261/80 X |
| 3,640,515 | 2/1972 | Stiles | 261/92 |
| 3,740,959 | 6/1973 | Foss | 261/80 X |
| 3,814,393 | 6/1974 | Malmgren | 261/80 |
| 3,823,926 | 7/1974 | Bracich | 261/DIG. 15 |

FOREIGN PATENT DOCUMENTS

| | | | |
|---|---|---|---|
| 700093 | 12/1964 | Canada | 261/80 |

*Primary Examiner*—Richard L. Chiesa

*Attorney, Agent, or Firm*—LeBlanc, Nolan, Shur & Nies

[57] ABSTRACT

A humidifier assembly comprising a housing that is open at the rear for slidable insertion of a frame carrying a motor driven endless porous water pickup pad and a bottom mounted water reservoir pan. When the housing is mounted on a plenum or the like these and other components within the housing are not accessible for removal from the housing. A special sheet metal subassembly mounts the pad and its supporting rollers and a motor for driving one of the rollers.

8 Claims, 9 Drawing Figures

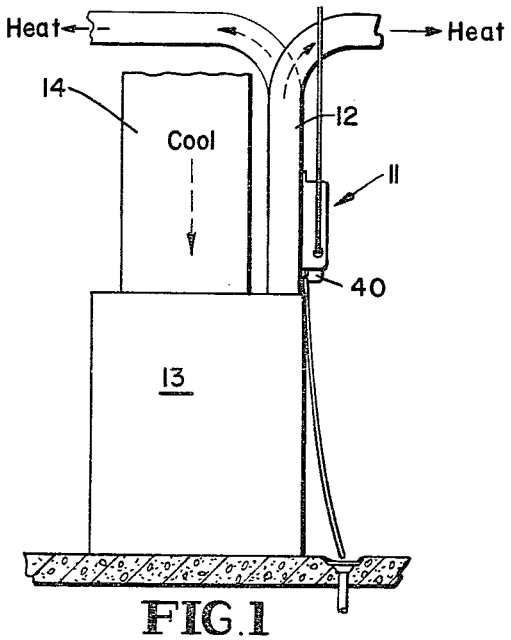
FIG. 1
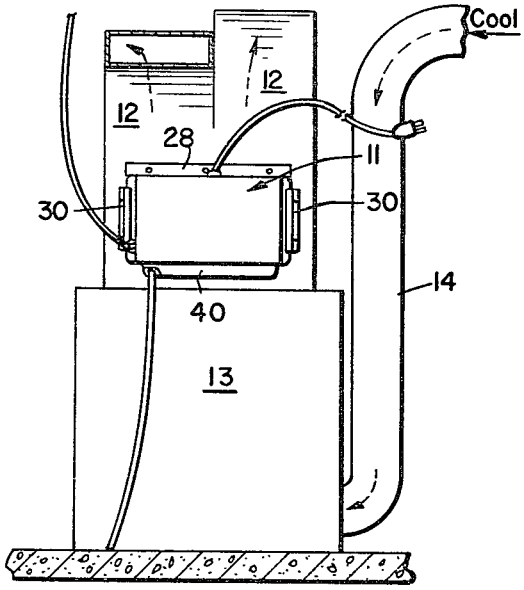
FIG. 2
FIG. 3
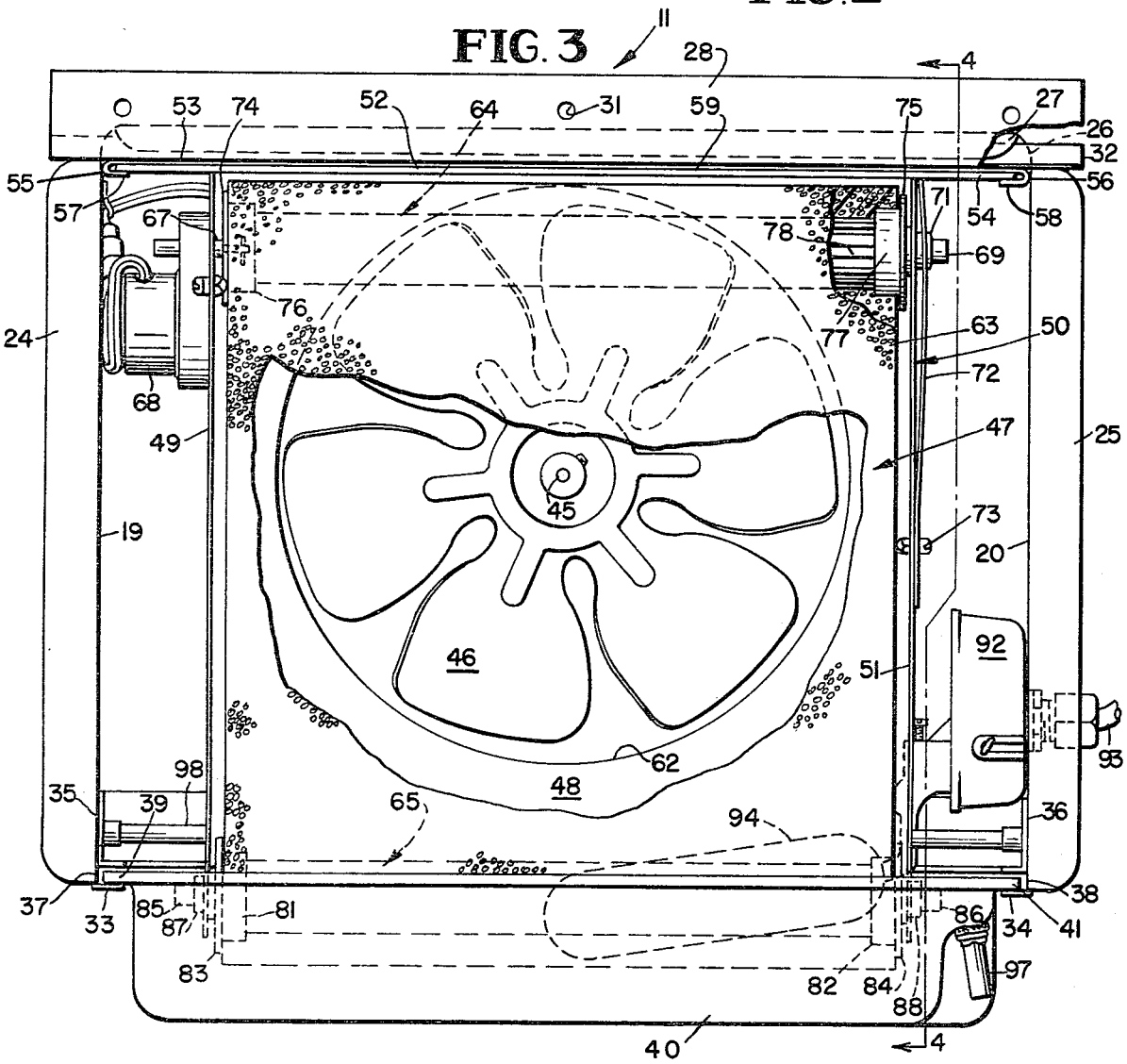

FIG. 4
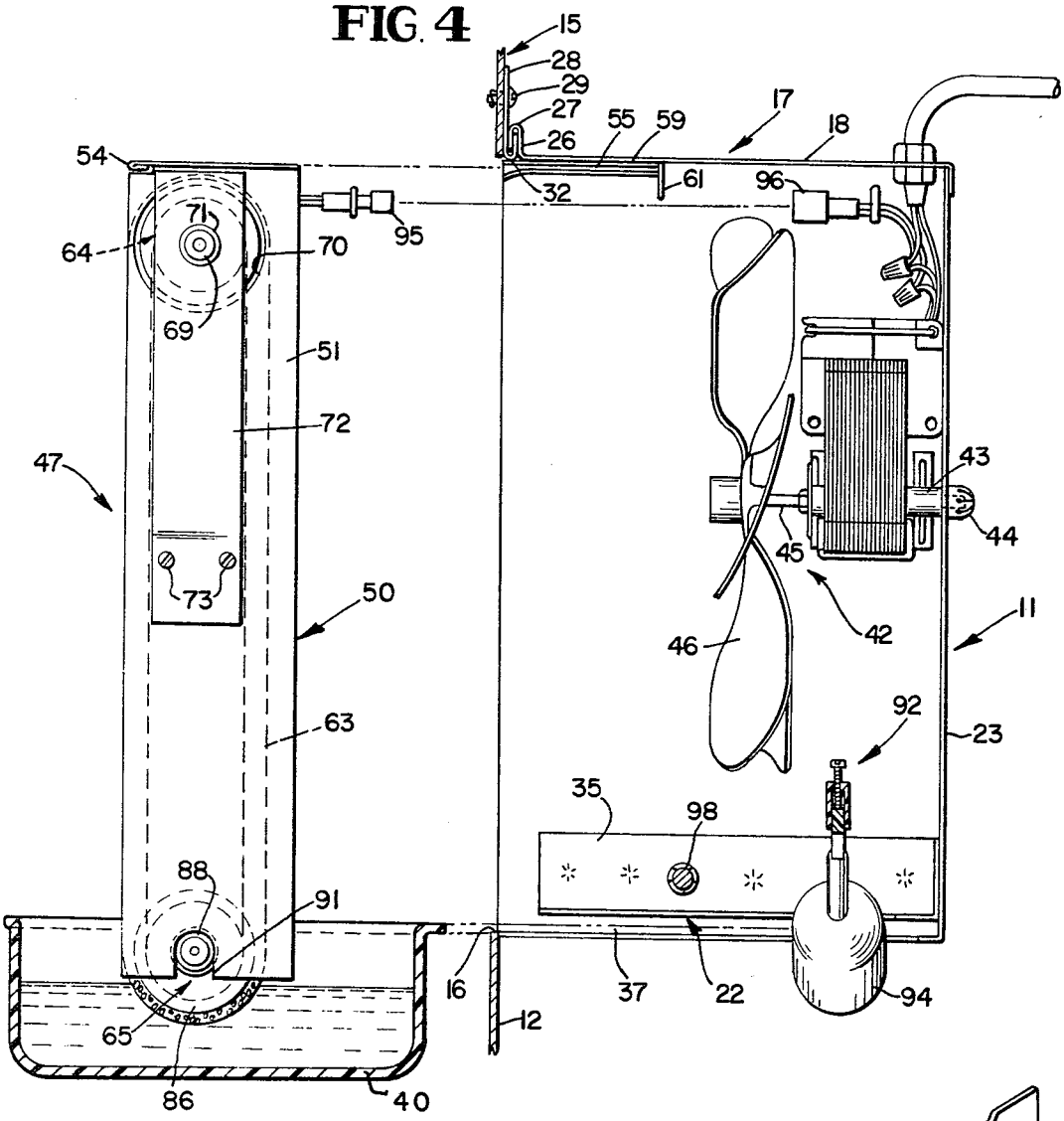
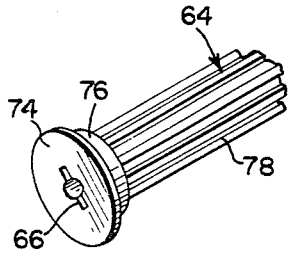
FIG. 5
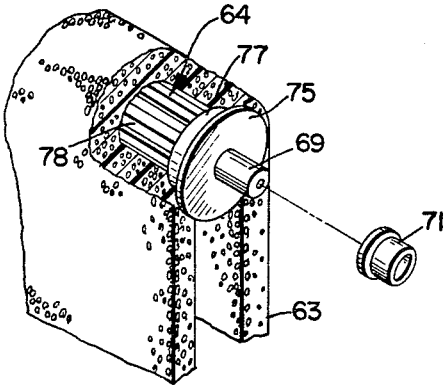
FIG. 6
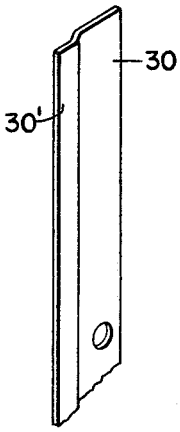
FIG. 7

HUMIDIFIER ASSEMBLIES

This invention relates to humidifier assemblies of the type wherein a motor driven fan forces air through a moving endless band pad of a porous somewhat resilient material such as foamed polyurethane, and is particularly concerned with the novel arrangement and mounting of components in such assemblies.

Humidifiers of the type wherein an endless band pad of water pick up material extending between two rollers, one of which is motor driven, with the pad lower end continually passing through a maintained level of water, while a motor driven fan forces air through the band to extract water and deliver it into a furnace plenum or the like, are known in several forms. Such prior art is exemplified by the patents to Martin, Jr. U.S. Pat. No. 1,817,442; Agerly U.S. Pat. No. 3,476,365; Foss U.S. Pat. No. 3,740,959 and Malmgren U.S. Pat. No. 3,814,393. Prior art of this type employing a foamed polyurethane pad is exemplified by Martin U.S. Pat. No. 3,339,902. A foamed polyurethane band pad passing over a ribbed roller is disclosed in the Canadian patent of Martin Canadian Pat. No. 700,093.

It is the major object of this invention to provide a novel humidifier of the foregoing type wherein the various components are mounted in a novel manner and in special efficient association, especially for assembly and servicing.

Another object of this invention is to provide a novel mode of mounting a humidifier assembly on a plenum of a warm air furnace in such manner that it is easily bodily removable from the plenum but removal of components is prevented unless the assembly is removed from the plenum.

Another object of the invention is to provide a novel humidifier assembly of this type wherein major components are mounted in a housing adapted to be secured over an opening in a plenum of a warm air furnace, or on a side wall of a console, and wherein there is no effective access to these components while the housing is attached to the plenum or console wall.

A further object of the invention is to provide a novel humidifier assembly having a housing adapted to be secured with an open rear end over an opening in a plenum of a warm air furnace or the like wherein major components such as a frame mounting the endless pad and the water reservoir pan are removable only through the open end of the housing when the housing is not on the plenum.

A further object of the invention is to provide a novel humidifier assembly of this type wherein the pad and its driving motor are mounted on a frame that is readily removable from the humidifier housing without disturbing other components.

Another object of the invention is to provide a novel humidifier subassembly wherein an endless band pad of porous material extends between spaced rollers on a special slidable frame unit that carries the motor for driving one of the rollers.

Further objects will appear as the description proceeds in connection with the appended claims and drawings.

BRIEF DESCRIPTION OF DRAWINGS

FIG. 1 is a side elevation illustrating the mounting of a humidifier assembly of the invention on the warm air return plenum of a warm air furnace;

FIG. 2 is a side elevation normal to FIG. 1;

FIG. 3 is a rear elevation of the humidifier assembly partly broken away for showing humidifier components;

FIG. 4 is an exploded side elevation partly in section further showing the removable components;

FIG. 5 is a fragmentary end view of a corrugated pad mounting roller;

FIG. 6 is a fragmentary view partly in section showing the other end of the roller of FIG. 5 with the pad on it;

FIG. 7 is a perspective view showing the nature of the side support strips by which the humidifier is mounted on the plenum;

PREFERRED EMBODIMENTS

Figure 9:
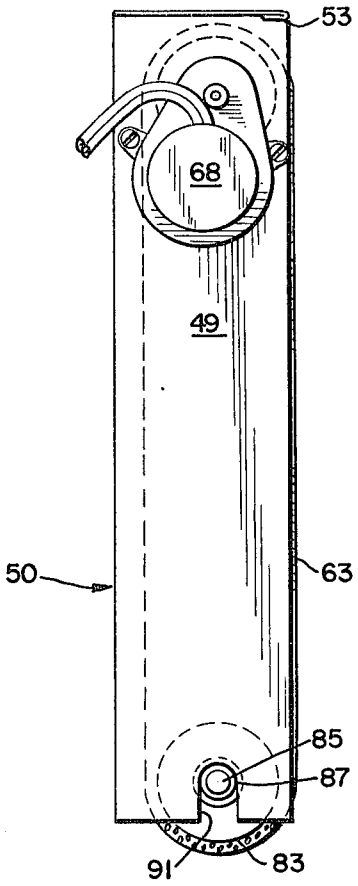
FIG. 9 is a side view of the subassembly of FIG. 8.
Figure 8:
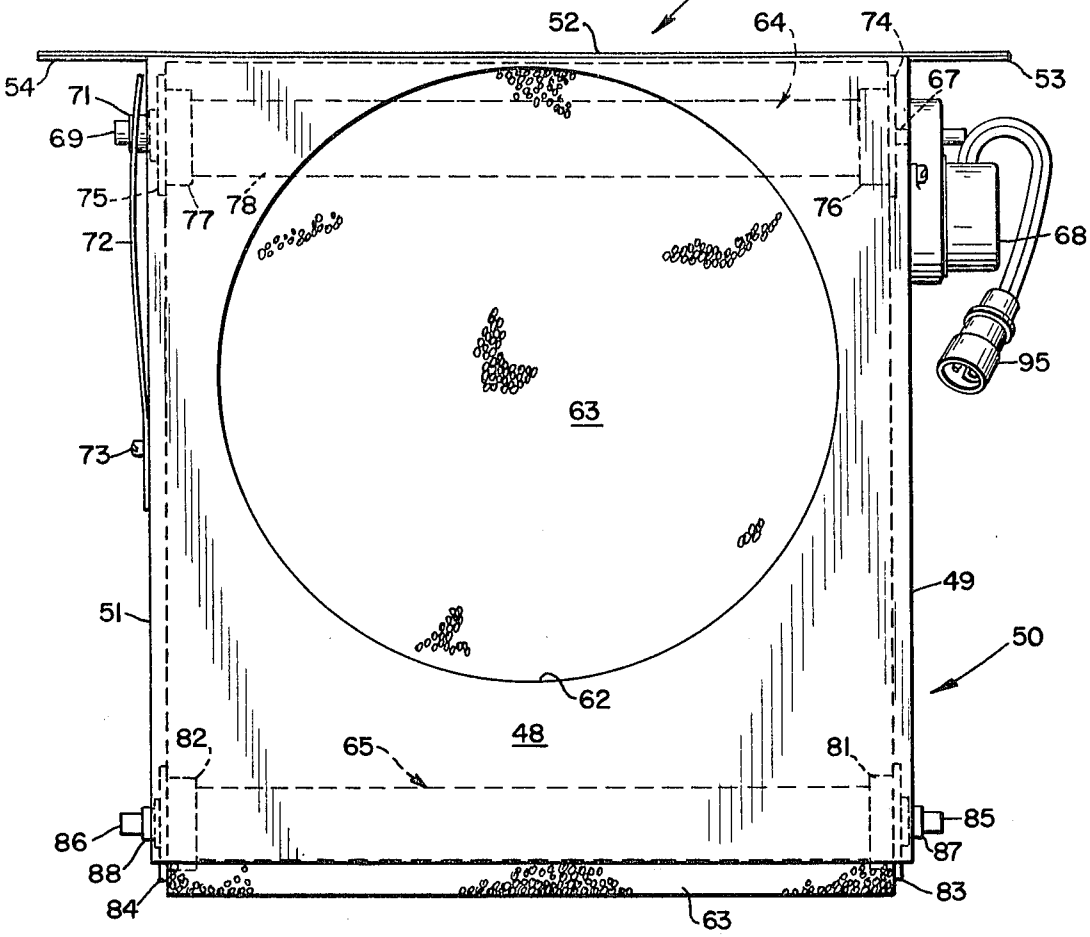
FIG. 8 is an elevation view showing the subassembly of frame, pad and motor apart from the humidifier assembly.

Referring to FIGS. 1 and 2, the humidifier assembly 11 of the invention is preferably mounted on the warm air distributing plenum 12 of a conventional hot air furnace 13 having a cool air return plenum 14.

As shown in FIG. 4 the flat sheet metal side wall 15 of plenum 12 is provided with a rectangular opening 16 of about the same size and shape as the open rear end of the humidifier housing 17.

Housing 17 has a top wall 18, side walls 19 and 21, an open bottom indicated at 22 and a front wall 23. Coplanar integral tabs 24 and 25 extend laterally outwardly along the edges of the housing side walls along opening 16. An integral tab 26 along the rear edge of top wall 18 extends upwardly and (FIG. 4) is bent over to form a downwardly open U-shaped channel 27.

A stiff mounting strip 28 is adapted to be secured to the plenum wall parallel to the upper edge of opening 16 by screws 19 passing through openings 31, and strip 28 is J-shaped at its lower end 32 to receive the outer leg of channel 27. Strip 28 may be a separate element, or it may be a combined part of the humidifier assembly as shown in FIG. 3. When housing 17 is thereby mounted on the plenum with strip 28 secured to the plenum wall and channel 27 seated in strip 28, the housing is effectively suspended from strip 28 and tabs 24 and 25 seat flush with the outer side surface of the plenum along edges of opening 16. There is thus no access to the interior of housing 17 or the components therein unless the housing is detached from strip 28. As shown in FIG. 2 preferably the tabs 24, 25 are slidably disposed in parallel strips 30 secured as by screws to the plenum. These strips 30 have offset ledges 30′ as shown in FIG. 7 to embrace the tabs. Strips 30 in addition to holding the housing in place effectively prevent the housing 17 from being rocked about its mounting on strip 28, and for removal of the housing 17 from the plenum the housing must be slidably displaced upwardly to clear strips 30.

The housing bottom opening 22 is bordered by parallel inturned integral coplanar tabs 33 and 34 extending along the lower edges of the side walls. Within the housing L-shaped strips 35 and 36 are secured as by welding to the side walls parallel to tabs 33 and 34 and in such close relation thereto to provide oppositely facing guide channels 37 and 38 in the same plane and open at least to the rear of the housing 17.

As will appear these guide channels are adapted to slidably receive side flanges 39 and 41 along the open upper end of a water reservoir pan 40, which when mounted in said channels depends from and closes the bottom opening 22.

Interiorly of housing 17 an electric motor assembly 42 is fixedly mounted in the front wall 23 as by threaded end posts 43 and external nuts 44. The motor output shaft 45 carries a bladed fan 46.

A water pick up and distribution subassembly 47 is mounted for insertion and removal as a unit through the open rear end of housing 17. Subassembly 47 comprises a supporting frame 50 having a front plate 48, parallel side plates 49 and 51 and a top plate 52 that bridges the upper ends of the side plates and has opposite end guide extensions 53 and 54. This supporting frame is mounted within the housing 17 by inserting top plate extensions 53 and 54 slidably into oppositely facing guide channels 55 and 56 (FIG. 3) formed by inturning tabs 57 and 58 on the side edges of a reenforcing plate 59 fixed as by welding along the inner surface of the housing top wall. The length of the channels 54 and 55 is such that the frame of subassembly 47 may move parallel to the axis of motor shaft 45 as it enters housing 17.

Entry of the subassembly 47 into the interior of housing 47 is arrested by contact of frame 50 with a fixed stop ledge 61 which may be an integral extension of plate 59 or otherwise rigidly depending from the top wall of the housing.

As shown, front plate 48 has a large circular opening 62 slightly larger than and coaxial with fan 46 when subassembly 47 is mounted in housing 17.

An endless water pickup pad 63 is mounted to extend between and be carried by upper roller 64 and a lower roller 65 on frame 50.

Upper roller 64 extends between the frame side plates and has at one end a motor shaft receiving key opening 66 (FIG. 5) for driving connection with the output shaft 67 of a slow speed electric motor assembly 68 mounted on the outer side of side plate 49. As its other end roller 64 has a stub shaft 69 that extends freely through a large opening 70 in side plate 51 to be rotatably supported in a bushing 71 mounted on the free upper end of a leaf spring 72 whose lower end is secured to the outer side of plate 51 as by screws 73. Spring 72 maintains roller 64 parallel to the axis of fan 46 but permits small side play of the roller to compensate for uneven operating conditions.

As shown roller 64 is provided at opposite ends with enlarged diameter radial flanges 74 and 75, inwardly of those flanges with reduced diameter shoulders 76 and 77, and between the shoulders with a further reduced diameter portion 78 having longitudinal surface grooves and ribs.

The lower roller 65 is generally similar in construction to roller 64, having a central longitudinally grooved and ribbed portion 79, end shoulders 81 and 82 and end flanges 83 and 84. However roller 65 is not driven and its opposite ends have stub shafts 85 and 86 supported in bushings 87 and 88 slidably disposed in downwardly open U-shaped guide slots 89 and 91 on the lower edges of the frame side plates.

Pad 63 which is preferably a band of uniform thickness open pore foamed polyurethane and has some resilience extends between the rollers under some tension due to the weight of the suspended lower roller which effectively floats up and down on the frame. The lower roller may move up or down slightly as confined in its end guides which positively limit upward movement. The lower end of the pad, where it moves around the lower roller projects downwardly from frame 70 and is immersed in the water of reservoir 40. As the pad picks up water it increases in weight and at the same time may stretch to lower roller 65 and place the pad under tension which aids the water distribution action of the air stream passing through it. The combination of the provision for end play in the upper roller and float of the lower roller is effective in compensation for any slight non-parallelism of the rollers and mechanical tolerances in the parts, as well as changes in length of the saturated pad during operation.

A water valve assembly 92 is mounted on the housing side wall 20 and may be connected to an inlet supply line 93. Valve assembly 92 is of the float operated type and is controlled by a float 94 to maintain a predetermined water level in pan 40, that level being such that the lower portion of continuously moving pad 63 will be immersed and in moving pass through the water (FIG. 4) thereby insuring continuous pickup of water during operation. The valve assembly 92 and its float control may advantageously be that disclosed in Powers U.S. Pat. No. 3,099,286.

Assembly of the humidifier is efficient and simple. The fan, water valve and other fixedly located components are installed in the sheet metal housing 17. The frame 50 is separately fabricated, and the rollers, pad and drive motor 68 mounted thereon to complete the water pickup subassembly which may be slidably inserted as a unit into the open rear end of the housing, stopped in correct position by contact with ledge 61 and a rigid brace rod 98 that extends between side walls 19 and 20. Preferably the electrical supply to motor 68 is completed by plug 95 snapping into receptacle 96 in the already installed electrical wiring. The pan 42 is slidably introduced into the open rear end of the housing, float 94 being lifted and allowed to rest within the pan.

Now the assembly is ready to be mounted on the plenum. A rectangular opening of proper size is cut in the plenum wall, and strip 28 and side strips 30 may be installed. The housing is slidably moved down with tabs 24, 25 between strips 39 and the plenum wall until channel 27 seats on the strip 28. As pointed out above strip 28 may be part of the humidifier assembly, in which case screws 29 are installed after the humidifier assembly is in place over the plenum opening. The water and electrical sources are attached to complete assembly.

The humidifier is automatic in operation, the electrical system being controlled from a conventional humidistat (not shown) and the water intake being controlled by float 94. Pan 40 has an emergency drain outlet 97.

From the foregoing it will be seen that access to major components such as the pad and the reservoir pan is prevented unless the housing 17 is separated from the plenum. This avoids accidents that might occur in attempting to work on the operative assembly. Separation is quick and efficient by moving the entire assembly up out of guide strips 30.

While the invention has been illustrated and specifically described in a preferred embodiment in association with a furnace plenum, it is equally applicable to installation of the humidifier unit on the wall of a console type humidifier unit.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A removable humidifier subassembly comprising a frame having a front member and parallel side members, generally parallel upper and lower rollers extending between said side members, motor means on the outer side of one of the side members for driving the upper roller, means in the lower ends of the side members mounting the ends of the lower roller for free rotation, an endless pad of water pickup material mounted on said rollers and adapted to be driven by the motor operated upper roller, and said front member being apertured sufficiently to allow passage of air therethrough and through the pad intermediate said rollers, and substantially horizontal slide members on the upper end of said frame extending oppositely laterally outwardly from the upper ends of said side members above the level of said upper roller adapted for slidable interfit with sockets in a supporting housing for removably mounting the subassembly in said housing.

2. The humidifier subassembly defined in claim 1, wherein the means mounting the lower roller comprises side guide means permitting float of the lower roller toward and from the upper roller.

3. The humidifier subassembly defined in claim 1, wherein said front member is a plate having an aperture that extends at least across and along the major length of the pad portion between the rollers.

4. A removable humidifier subassembly comprising a frame having front and side members, generally parallel upper and lower rollers extending between said side members, motor means on the outer side of one of the side members for driving the upper roller, means in the lower ends of the side members mounting the ends of the lower roller for free rotation, an endless pad of water pickup material mounted on said rollers and adapted to be driven by the motor operated upper roller, said front member being apertured sufficiently to allow passage of air therethrough and through the pad intermediate said rollers, and laterally outwardly extending slide members on the upper end of said frame adapted for removably mounting the subassembly in a housing, said upper roller having one end adapted for drive connection to said motor means, a coaxial bushing mounting the motor connected end of the roller and a leaf spring carrying said bushing whereby said bushing is spring biased toward that other end of the roller.

5. A humidifier assembly comprising a housing having a front wall mounting a motor driven fan within the housing and having a rear opening, mounting means on said housing adapted for removably mounting said housing on a plenum or the like having an opening for operative register with said housing rear opening, a water reservoir on the lower end of said housing, a frame carrying a motor driven porous water pickup pad, and means whereby said frame may be slidably inserted into said housing into operative location through said rear opening so that said pad is registered with said openings and has its lower end immersed in water in said reservoir, said frame being removable from the housing only through said rear opening so that said frame is not accessible for removal from the housing except when the entire housing is removed from said plenum or the like, said housing being also open at its lower end, and said water reservoir being a pan-like member having means whereby it may be independently slidably inserted into guide means at the lower end of said rear housing opening to be disposed in covering relation to said bottom opening and in operative association with said pad, said member being also non-accessible for removal from the housing except when the entire housing is removed from said plenum or the like.

6. The humidifier defined in claim 5, wherein said housing is substantially entirely open at its rear and said rear opening is generally rectangular, slide tabs on the side edges of said rear opening for coaction with slide guide means for mounting the housing on the plenum or the like, and means extending along the upper edge of said housing rear opening for cooperating with means on the plenum or the like for suspending said housing on the plenum or like with said pad being effectively disposed to extend over the major area of said opening.

7. The humidifier defined in claim 5, wherein said housing rear opening is generally rectangular and the housing is provided with slide guide means open at the upper edge of said rear opening for receiving said frame, and said housing is provided with slide guide means open at the lower edge of said opening for receiving said water reservoir, and stop means is provided within the housing for arresting inward movement of said frame when the pad is disposed substantially in the plane of said rear opening.

8. The humidifier assembly defined in claim 7, wherein said pad is an endless porous band mounted on upper and lower rollers rotatably mounted on said frame, and an electric motor connected for driving one of said rollers is mounted on the frame.

* * * * *